US007388592B2

(12) United States Patent
Chuang et al.

(10) Patent No.: US 7,388,592 B2
(45) Date of Patent: Jun. 17, 2008

(54) GAMMA VOLTAGE GENERATOR AND METHOD THEREOF FOR GENERATING INDIVIDUALLY TUNABLE GAMMA VOLTAGES

(75) Inventors: Chao-Hsuan Chuang, Jhubei (TW); Jing-Meng Liu, Hsinchu (TW); Shin-Lung Ho, Jhubei (TW); Wen-Hung Huang, Yangmei Township, Taoyuan County (TW); Cheng-Yuan Chang, Yonghe (TW)

(73) Assignee: Richtek Technology Corp., Hsinchu (TW)

( * ) Notice: Subject to any disclaimer, the term of this patent is extended or adjusted under 35 U.S.C. 154(b) by 661 days.

(21) Appl. No.: 10/765,039

(22) Filed: Jan. 28, 2004

(65) Prior Publication Data

US 2004/0233182 A1 Nov. 25, 2004

(30) Foreign Application Priority Data

Jan. 30, 2003 (TW) ..... 92102447 A

(51) Int. Cl.
*G09G 3/36* (2006.01)

(52) U.S. Cl. ..... 345/690; 345/89; 345/204; 345/211

(58) Field of Classification Search ..... 345/690, 345/211, 88–89, 208–209, 204, 94–96
See application file for complete search history.

(56) References Cited

U.S. PATENT DOCUMENTS

| | | | | |
|---|---|---|---|---|
| 5,680,149 | A * | 10/1997 | Koyama et al. | 345/98 |
| 7,193,637 | B2 * | 3/2007 | Kudo et al. | 345/690 |
| 2002/0158862 | A1 * | 10/2002 | Chen et al. | 345/211 |
| 2002/0186231 | A1 * | 12/2002 | Kudo et al. | 345/690 |
| 2003/0080931 | A1 * | 5/2003 | Chen et al. | 345/88 |
| 2003/0122754 | A1 * | 7/2003 | Bu | 345/87 |
| 2004/0217981 | A1 * | 11/2004 | Bu | 345/690 |

* cited by examiner

*Primary Examiner*—Lun-Yi Lao
(74) *Attorney, Agent, or Firm*—Rosenberg, Klein & Lee

(57) ABSTRACT

In a gamma voltage generator and gamma voltage generating method that can tune the gamma voltages individually, several gamma currents of a same magnitude are generated for each to flow through a variable resistive element to generate a variable common voltage and several variable voltages, from which a common gamma voltage and several first gamma voltages are generated. By use of the symmetric property of the gamma curve corresponding to those gamma voltages to be generated, several voltages are generated by mapping the first gamma voltages with the common gamma voltage as the center axis, and from which several second gamma voltages are derived. The common gamma voltage and the first and second gamma voltages are provided for those gamma voltages corresponding to the gamma curve.

33 Claims, 7 Drawing Sheets

GAMMA VOLTAGE GENERATOR AND METHOD THEREOF FOR GENERATING INDIVIDUALLY TUNABLE GAMMA VOLTAGES

FIELD OF THE INVENTION

The present invention relates generally to a gamma voltage generator and gamma voltage generating method, and more particularly, to a gamma voltage generator and method thereof to generate a plurality of gamma voltages that can be individually adjusted.

BACKGROUND OF THE INVENTION

Thin film transistor liquid crystal display (TFT-LCD) requires gamma voltage generator to generate gamma voltages corresponding to a gamma curve related to the characteristics of the TFT-LCD to adjust its display effect. Specifically, the gamma curve is typically symmetric in the manner that it has a central gamma voltage and two groups of gamma voltages symmetric to each other with the central gamma voltage as the symmetric center thereof. FIG. 1 shows a conventional gamma voltage generator 10, which comprises a voltage divider 12 connected between a supply voltage $V_S$ and ground GND, and the voltage divider 12 is composed of several resistors $R_1$, $R_2$, $R_3$, . . . , $R_{k+1}$ connected in series, so as to divide the supply voltage $V_S$ to be several voltages $V_{R1}$, $V_{R2}$, $V_{R3}$, . . . , $V_{Rk}$ that are further buffered by respective operational amplifiers $AMP_1$, $AMP_2$, $AMP_3$, . . . , $AMP_k$ to output the gamma voltages $V_{G1}$, $V_{G2}$, $V_{G3}$, . . . , $V_{Gk}$. Since the gamma voltage generator 10 generates the gamma voltages by the voltage divider 12 composed of several resistors connected in series, whenever any one among these resistors in the voltage divider 12 is adjusted to tune the corresponding gamma voltage, all the other gamma voltages are also altered in the same time. In order to keep the other gamma voltages correct, any tuning among these gamma voltages requires the overall change of the resistors, and which is time-consuming and inconvenient in use.

To improve the above disadvantage, another gamma voltage generator 20 is proposed, as shown in FIG. 2, in which the gamma voltages $V_{G1}$, $V_{G2}$, $V_{G3}$, . . . , $V_{Gk}$ are generated from a supply voltage $V_S$ divided by resistor pairs [$R_{10}$, $R_{12}$], [$R_{20}$, $R_{22}$], [$R_{30}$, $R_{32}$], . . . , [$R_{k0}$, $R_{k2}$], respectively. When the gamma voltage generator 20 is desired to be adjusted with any one of the gamma voltages $V_{G1}$, $V_{G2}$, $V_{G3}$, . . . , $V_{Gk}$, only the corresponding resistor pair is changed. Even though the gamma voltage generator 20 can be adjusted with its gamma voltages individually, the number of the resistors that are external to the chip they are connected is twice of that required by the gamma voltage generator 10, and as a result, the circuit of the gamma voltage generator 20 becomes more complex. Moreover, the chip using such gamma voltage generators is required to prepare more pins for the generated gamma voltages.

Therefore, it is desired a gamma voltage generator that requires less pins when it is used and is able to individually tune the gamma voltages it generates.

SUMMARY OF THE INVENTION

An object of the present invention is to propose a gamma voltage generator and gamma voltage generating method that is able to tune the gamma voltages individually.

Another object of the present invention is to propose a gamma voltage generator and gamma voltage generating method that requires fewer pins for the chip to connect thereto.

In a gamma voltage generator and gamma voltage generating method, according to the present invention, a plurality of variable resistive elements are supplied respectively with a plurality of gamma currents of a same magnitude from a current source to generate a variable common voltage and a plurality of variable voltages, from which a common gamma voltage and a plurality of first gamma voltages are generated, a mirror mapping circuit generates a plurality of mapped voltages from the first gamma voltage with the common gamma voltage as a reference and from which a plurality of second gamma voltages are generated. The first and second gamma voltages are symmetric to each other with the common gamma voltage as the central axis, and the common gamma voltage and the first and second gamma voltages are thus provided for the gamma voltages corresponding to a gamma curve.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
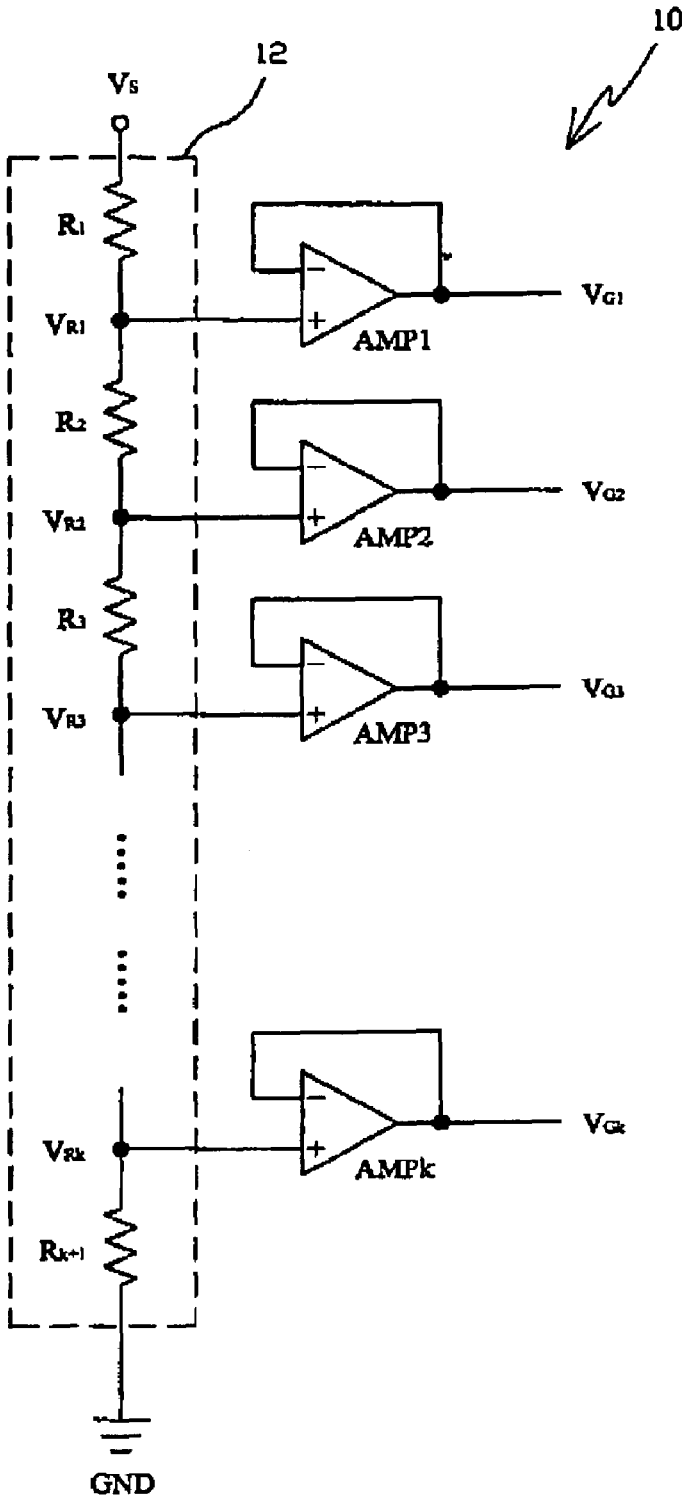
Fig. 1 PRIOR ART
FIG. 1 shows a conventional gamma voltage generator.
Figure 2:
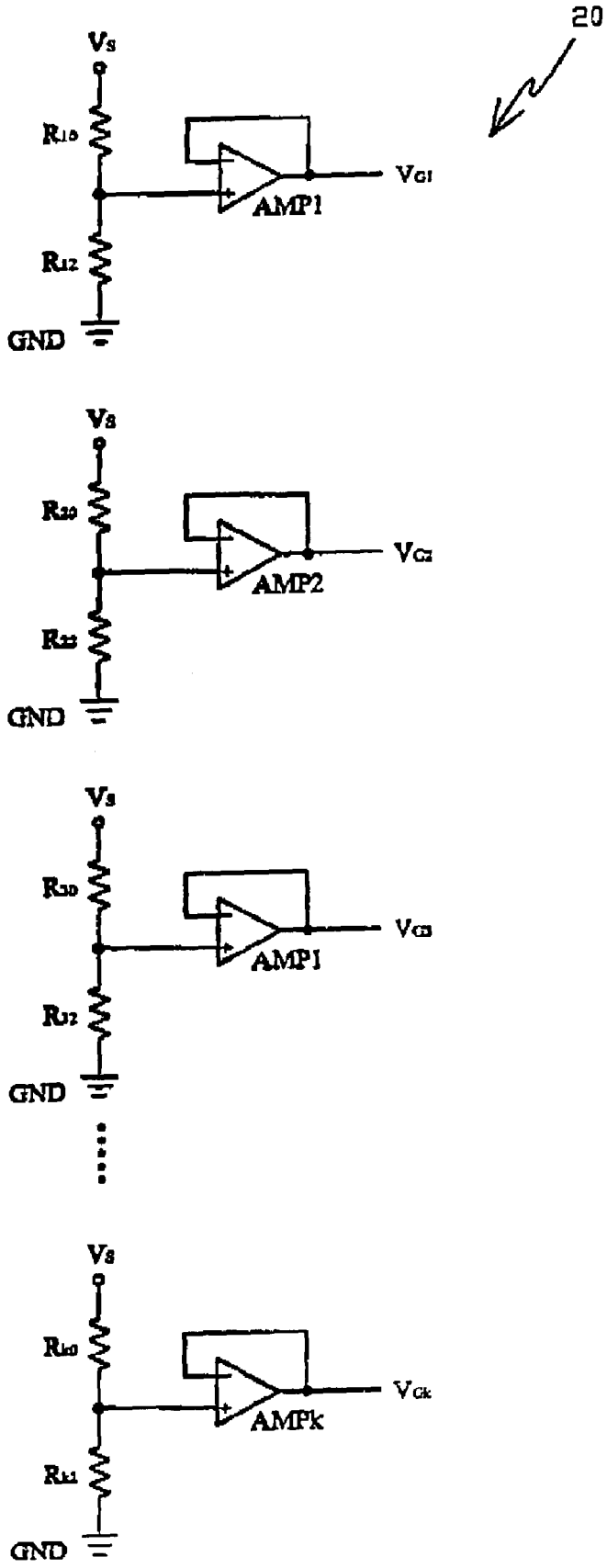
Fig. 2 PRIOR ART
FIG. 2 shows another conventional gamma voltage generator.
Figure 3:
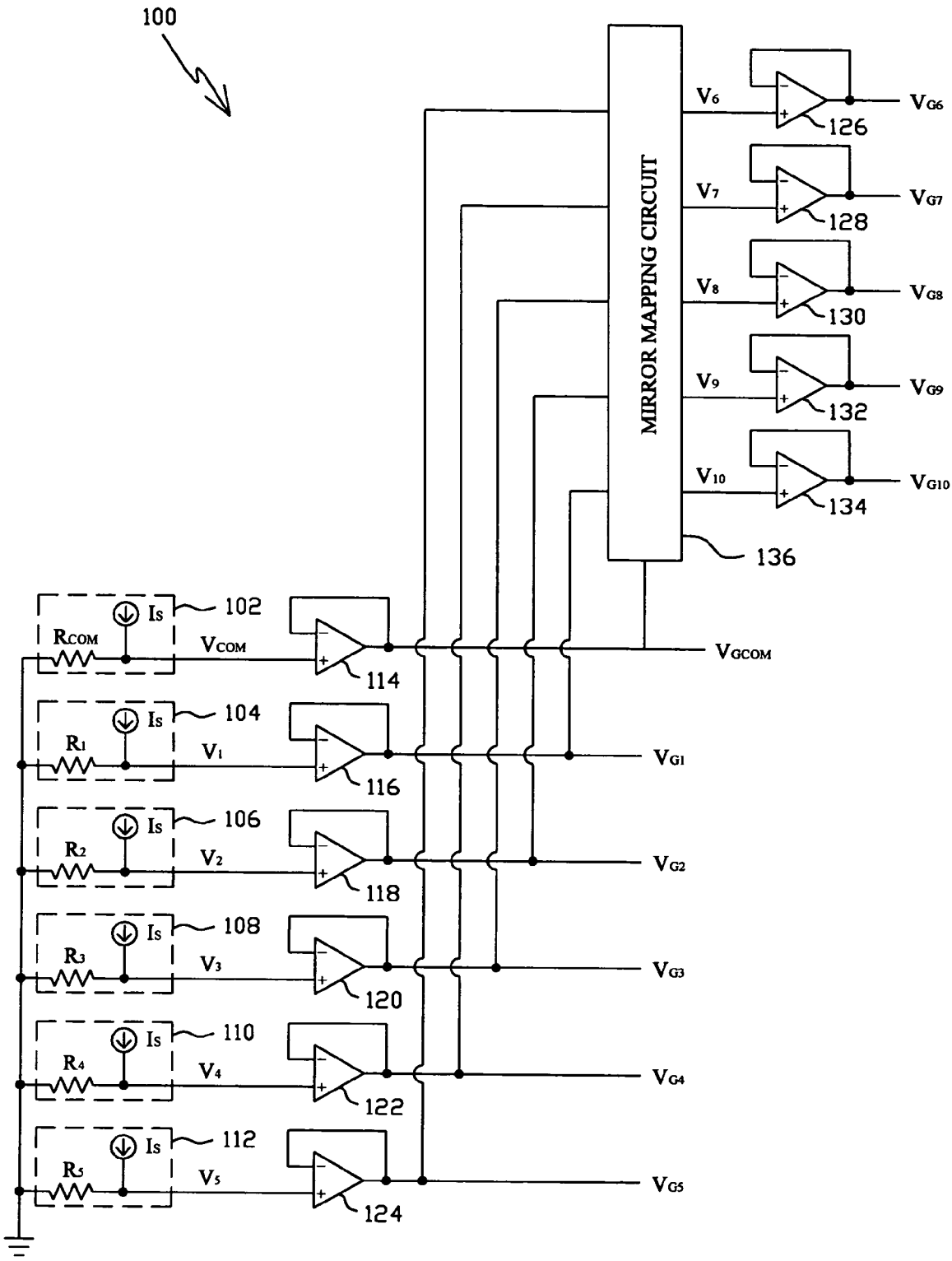
FIG. 3 shows a gamma voltage generator according to the present invention.

FIG. 3 shows a gamma voltage generator 100 according to the present invention, which comprises several independent voltage sources 102 to 112 to provide a variable common voltage $V_{COM}$ and several variable voltages $V_1$ to $V_5$ to buffer operational amplifiers 114 to 124, to further generate a common gamma voltage $V_{GCOM}$ and several gamma voltages $V_{G1}$ to $V_{G5}$, and a mirror mapping circuit 136 to generate several mapped voltages $V_6$ to $V_{10}$ by mapping the gamma voltages $V_{G1}$ to $V_{G5}$ with the common gamma voltage $V_{GCOM}$ as a reference to buffer operational amplifiers 126 to 134 to further generate gamma voltages $V_{G6}$ to $V_{G10}$. In the voltage sources 102 to 112, several variable resistors $R_{COM}$ and $R_1$ to $R_5$ each is supplied with a gamma current $I_S$ that has a same magnitude for each of the voltage sources 102 to 112 to generate the voltages $V_{COM}$ and $V_1$ to $V_5$. If any one of the gamma voltages $V_{GCOM}$ and $V_{G1}$ to $V_{G5}$ is desired to be tuned individually, only the corresponding resistor among $R_{COM}$ and $R_1$ to $R_5$ has to be changed. Furthermore, since the gamma voltages $V_{G6}$ to $V_{G10}$ are generated by mapping the gamma voltages $V_{G5}$ to $V_{G1}$, respectively, with the common gamma voltage $V_{GCOM}$ as the mapping reference, tuning the gamma voltages $V_{COM}$ and $V_1$ to $V_5$ will automatically tuning the gamma voltages $V_{G6}$ to $V_{G10}$ in the same time.

Figure 4:
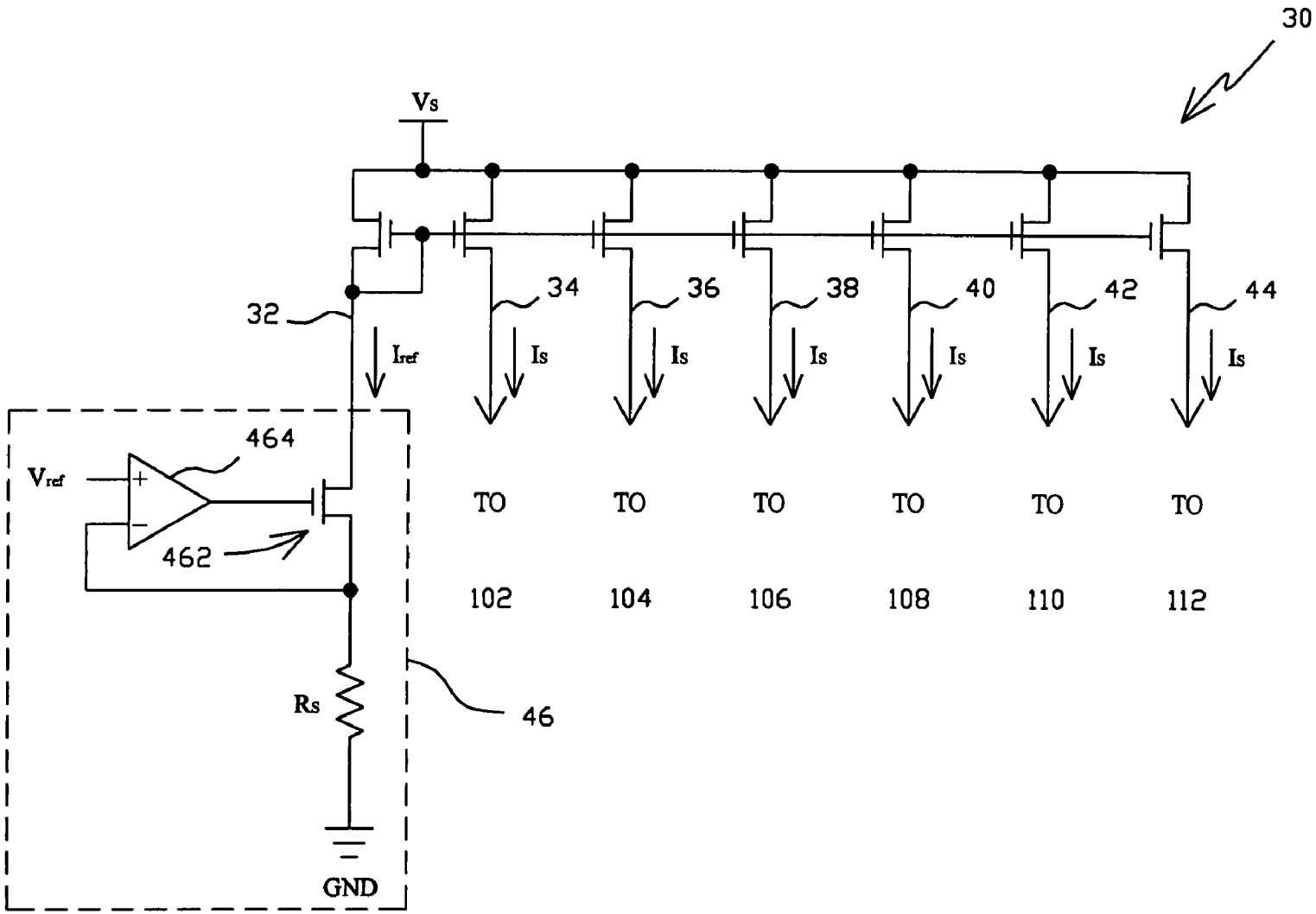
FIG. 4 shows a current mirror for the gamma voltage generator shown in FIG. 3.

A current mirror 30, as shown in FIG. 4, provides the gamma currents $I_S$ for the resistors $R_{COM}$ and $R_1$ to $R_5$, and the current mirror 30 comprises a reference branch 32 connected with a reference current $I_{ref}$ provided by a current source 46, and several mirror branches 34, 36, 38, 40, 42 and 44 to mirror the reference current $I_{ref}$, respectively, to generate the respective gamma currents $I_S$ for the resistors $R_{COM}$ and $R_1$ to $R_5$ of the voltage sources 102 to 112. The current source 46 comprises a reference resistor $R_S$ connected between ground GND and a transistor 462 that is further connected to the reference branch 32, and an operational amplifier 464 with a non-inverted input connected to a reference voltage $V_{ref}$, an inverted input connected to the resistor RS and the transistor 462, and an output connected to the gate of transistor 462. For $$I_S=I_{ref}=V_{ref}/R_S, \quad \text{[EQ-1]}$$

adjustment of either the reference resistor $R_S$ or the reference voltage $V_{ref}$ will change the magnitude of the gamma current $I_S$.

Figure 5:
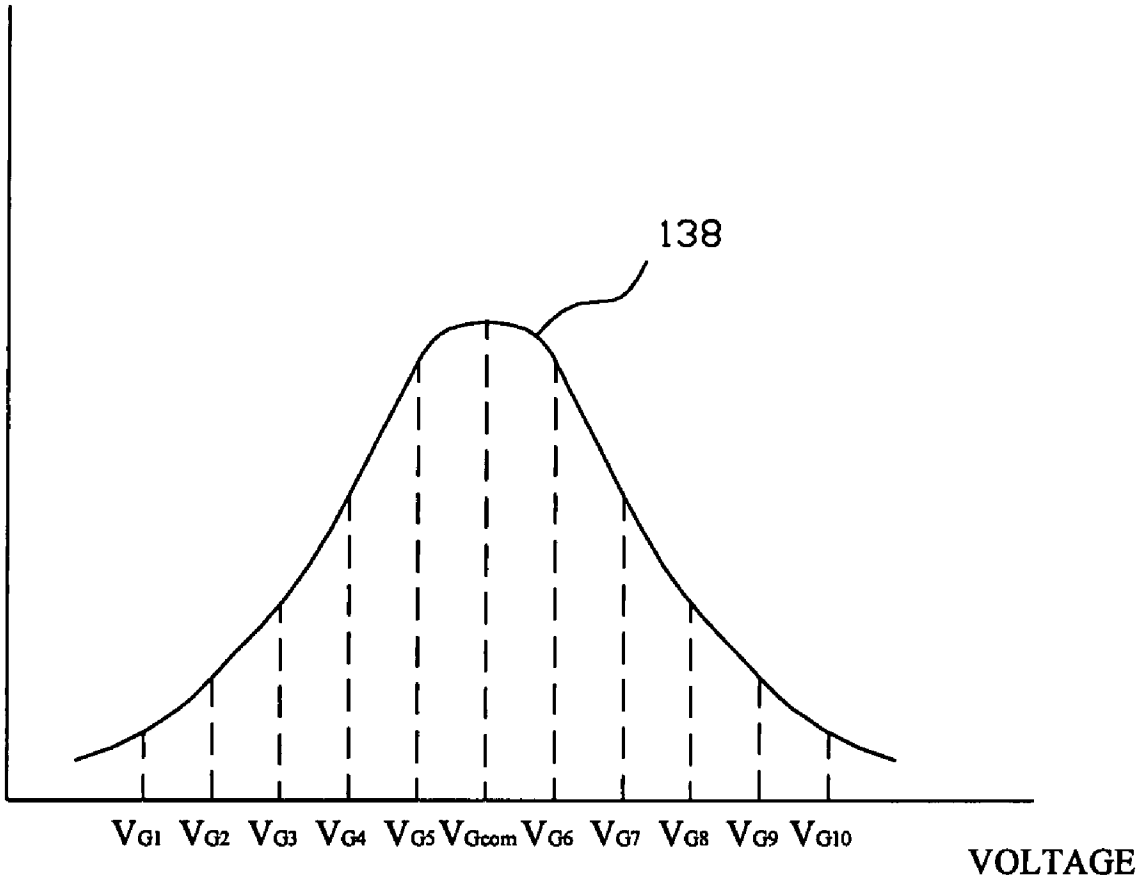
FIG. 5 shows a gamma curve of the gamma voltage generator shown in FIG. 3.

Referring to FIG. 3 for the gamma voltage generator 100, the first group of the gamma voltages $V_{G1}$ to $V_{G5}$ and the other group of the gamma voltages $V_{G6}$ to $V_{G10}$ generated by mapping the first group of the gamma voltages $V_{G1}$ to $V_{G5}$ are symmetric to each other with respect to the common gamma voltage $V_{GCOM}$ as the symmetric center, corresponding to a gamma curve 138 as shown in FIG. 5.

In more detail, using the symmetric property of the gamma curve, the common gamma voltage $V_{GCOM}$ and the first gamma voltages $V_{G1}$ to $V_{G5}$ are generated first, and then the common gamma voltage $V_{GCOM}$ is used as the center axis to map the first gamma voltages $V_{G1}$ to $V_{G5}$ to generate the second gamma voltages $V_{G6}$ to $V_{G10}$. In other words, the first gamma voltages $V_{G1}$ to $V_{G5}$ and the second gamma voltages $V_{G6}$ to $V_{G10}$ are symmetric to each other with the common gamma voltage $V_{GCOM}$ as their center. Since the second gamma voltages $V_{G6}$ to $V_{G10}$ are directly generated from the common gamma voltage $V_{GCOM}$ and the first gamma voltages $V_{G1}$ to $V_{G5}$, no pins are required for them for the chip and thus the number of the pins are reduced by a half.

Figure 6:
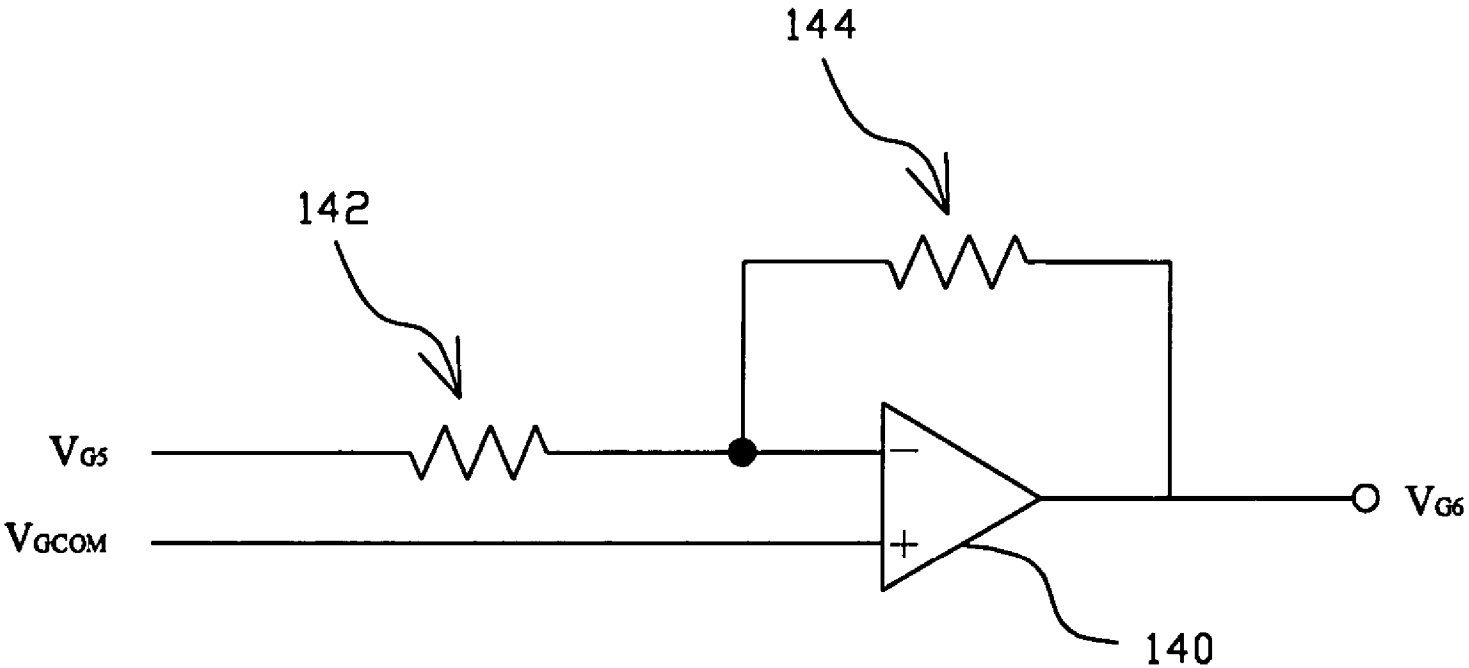
FIG. 6 shows an embodiment mirror mapping circuit for the gamma voltage generator shown in FIG. 3.

FIG. 6 shows an embodiment for the mirror mapping circuit 136 shown in FIG. 3. To generate the gamma voltage $V_{G6}$, for example, an operational amplifier 140 has a non-inverted input connected with the common gamma voltage $V_{GCOM}$, an inverted input connected with the gamma voltage $V_{G5}$ through a resistor 142, and another resistor 144 connected between the inverted input and the output of the operational amplifier 140. For $$(V_{G6}-V_{GCOM})/R_{144}=(V_{GCOM}-V_{G5})/R_{142}, \quad \text{[EQ-2]}$$

where $R_{144}$ and $R_{142}$ are the resistances of the resistors 144 and 142, respectively, and when $R_{144}=R_{142}$, it is obtained $$|V_{G6}-V_{GCOM}|=|V_{G5}-V_{GCOM}|, \quad \text{[EQ-3]}$$

and obviously, the gamma voltages $V_{G5}$ and $V_{G6}$ are symmetric to each other with respect to $V_{GCOM}$ as the center axis.

Figure 7:
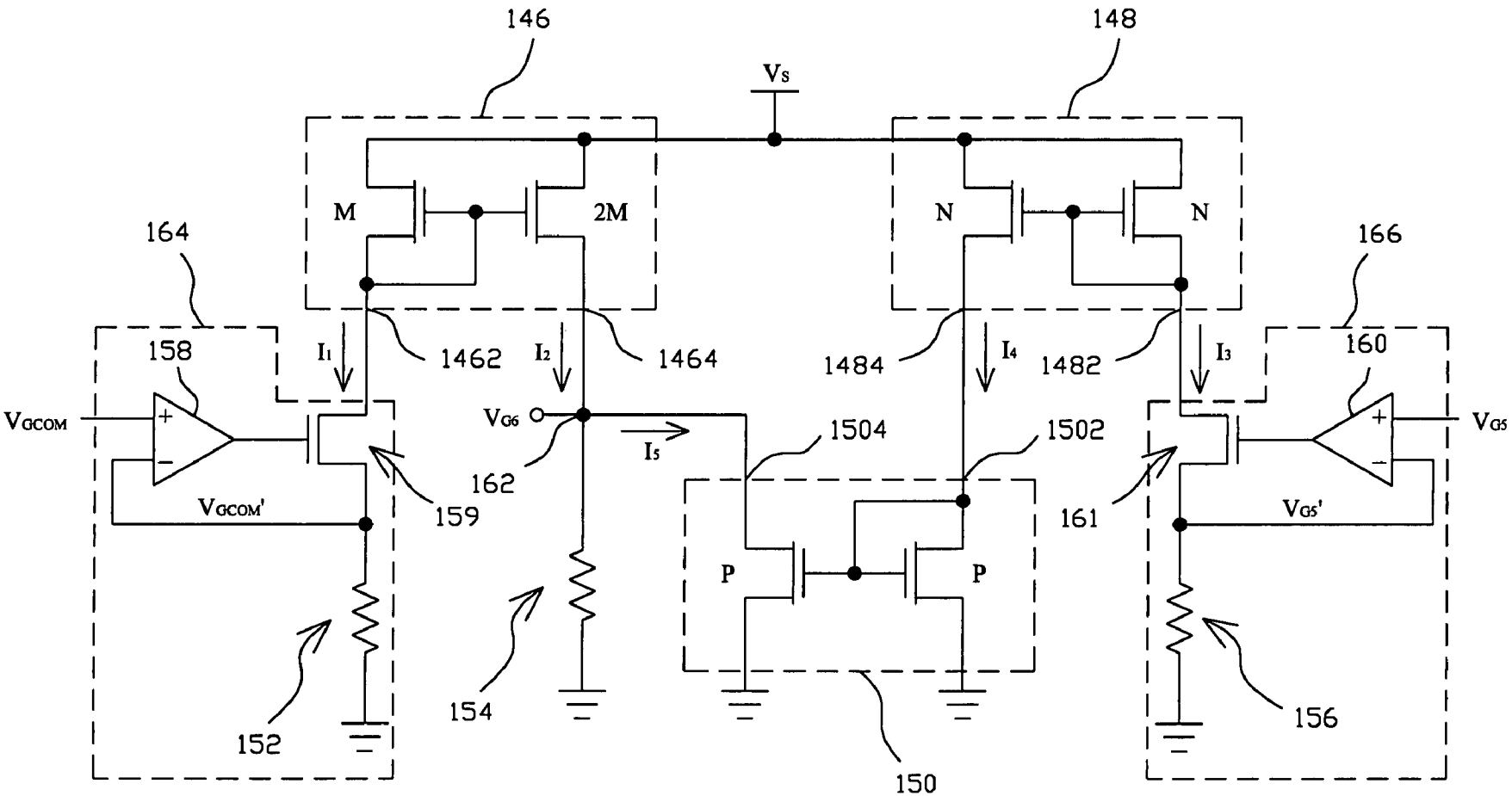
FIG. 7 shows another embodiment mirror mapping circuit for the gamma voltage generator shown in FIG. 3.

FIG. 7 shows another embodiment for the mirror mapping circuit 136 shown in FIG. 3. Again, to generate the gamma voltage $V_{G6}$, three current mirrors 146, 148 and 150, and three resistors 152, 154 and 156 of a same resistance are used. The current mirror 146 has its reference branch 1462 connected to a current source 164, and its mirror branch 1464 connected to the resistor 154 and the mirror branch 1504 of the current mirror 150. The current source 164 provides a current $I_1$ for the reference branch 1462 according to the gamma voltage $V_{GCOM}$, and it comprises a resistor 152 connected between ground GND and a transistor 159 that is further connected to the reference branch 1462 of the current mirror 146, and an operational amplifier 158 with its non-inverted input connected to the gamma voltage $V_{GCOM}$, inverted input connected to the resistor 152, and output connected to the gate of the transistor 159. The current mirror 148 has a reference branch 1482 connected to a current source 166, and a mirror branch 1484 connected to the reference branch 1502 of the current mirror 150. The current source 166 provides a current $I_3$ for the reference branch 1482 according to the gamma voltage $V_{G5}$, and it comprises a resistor 156 connected between ground GND and a transistor 161 that is further connected to the reference branch 1482 of the current mirror 148, and an operational amplifier 160 with its non-inverted input connected to the gamma voltage $V_{G5}$, an inverted input connected to the resistor 156, and output connected to the gate of the transistor 161. M, N and P denoted in the three current mirrors 146, 148 and 150 represent the channel widths of the transistors besides thereto. Due to the gamma voltage $V_{GCOM}$ connected to non-inverted input of the operational amplifier 158, a voltage $V_{GCOM}'$ is present on the inverted input of the operational amplifier 158 and applied to the resistor 152, and thus a current $I_1$ is induced on the reference branch 1462 of the current mirror 146. For the ratio of the channel widths of the transistors in the current mirror 146 is M:2M, the output of the mirror branch 1464 is double, i.e., $I_2=2\times I_1$. On the other hand, due to the gamma voltage $V_{G5}$ connected to the non-inverted input of the operational amplifier 160, a voltage $V_{G5}'$ is present on the inverted input of the operational amplifier 160 and applied to the resistor 156, and thus a current $I_3$ is generated on the reference branch 1482 of the current mirror 148. For the ratio of the channel widths of the transistors in the current mirror 148 is N:N, the output of the mirror branch 1484 is the same, i.e., $I_4=I_3$. The reference branch 1502 of the current mirror 150 receives the mirrored current $I_4$, and the ratio of the channel widths of the transistors in the current mirror 150 is P:P, it is thus obtained that the mirrored current $I_5=I_4$, and further $I_5=I_3$, since $I_4=I_3$. The gamma voltage output from the node 162 is $$V_{G6}=(I_2-I_5)\times R_{154}=I_2\times R_{154}-I_5\times R_{154}, \quad \text{[EQ-4]}$$

where $R_{154}$ is the resistance of the resistor 154. Since the resistors 152, 154 and 156 have the same resistance, and $I_2=2\times I_1$, $I_5=I_3$, the gamma voltage $$\begin{aligned} V_{G6} &= (2\times I_1)\times R_{152}-(I_3)\times R_{156} \quad \text{[EQ-5]} \\ &= 2(I_1\times R_{152})-(I_3\times R_{156}) \\ &= 2V_{GCOM'}-V_{G5'} \end{aligned}$$

Based on the principle of the virtual short between the non-inverted and inverted inputs of an operational amplifier, the non-inverted and inverted inputs of the operational amplifiers 158 and 160 are the same voltages, that is $$V_{GCOM}=V_{GCOM}',$$

and $$V_{G5}=V_{G5}'.$$

As a result, from equation EQ-5, $$V_{G6}=2V_{GCOM}'-V_{G5}'=2V_{GCOM}-V_{G5},$$

$$V_{G6}-V_{GCOM}=V_{GCOM}-V_{G5},$$

and $$|V_{G6}-V_{GCOM}|=|V_{G5}-V_{GCOM}|. \quad \text{[EQ-6]}$$

As for the situation of equation EQ-3, the gamma voltages $V_{G5}$ and $V_{G6}$ are symmetric to each other with respect to $V_{GCOM}$ as the center axis.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A gamma voltage generator for generating a plurality of individually tunable gamma voltages corresponding to a symmetric gamma curve, the generator comprising:

a plurality of adjustable voltage sources for providing an adjustable common voltage and a plurality of adjustable voltages to further derive a common gamma voltage and a plurality of first gamma voltages therefrom; and a mirror mapping circuit for mapping each of the plurality of first gamma voltages with the common gamma voltage as a reference to thereby generate a plurality of mapped voltages to further derive a plurality of second gamma voltages therefrom with the common gamma voltage as a center axis for the plurality of first and second gamma voltages distributed substantially symmetric to each other;

wherein the common gamma voltage and the plurality of first and second gamma voltages are provided for the gamma voltages corresponding to the gamma curve.

2. The gamma voltage generator of claim 1, wherein the mirror mapping circuit comprises a plurality of operational amplifiers each subtracting one of the plurality of first gamma voltages from double of the common gamma voltage to thereby generate corresponding one of the plurality of mapped voltages.

3. The gamma voltage generator of claim 1, wherein the mirror mapping circuit comprises a plurality of voltage converter each including:

a first current mirror having a first reference branch connected with the common gamma voltage and a first resistive element for generating a first current, and a first mirror branch for mirroring the first current to thereby generate a second current in a first ratio to the first current;

a second current mirror having a second reference branch connected with one of the plurality of first gamma voltages and a second resistive element for generating a third current, and a second mirror branch for mirroring the third current to thereby generate a fourth current in a second ratio to the third current; and a third resistive element connected with the second and fourth currents for generating corresponding one of the mapped voltages proportional to a difference between the second and fourth currents.

4. The gamma voltage generator of claim 3, wherein the first, second and third resistive elements comprise a substantially same resistance.

5. The gamma voltage generator of claim 1, wherein each of the plurality of adjustable voltage sources comprising:

an adjustable resistive element; and a gamma current flowing through the adjustable resistive element for generating one of the adjustable common voltage and the plurality of adjustable voltages.

6. The gamma voltage generator of claim 5, further comprising a current mirror for mirroring a reference current to thereby generate the gamma current.

7. The gamma voltage generator of claim 6, further comprising an adjustable current source for providing the reference current.

8. The gamma voltage generator of claim 7, wherein the adjustable current source comprises a second adjustable resistive element connected with a reference voltage for generating the reference current.

9. The gamma voltage generator of claim 7, wherein the adjustable current source comprises a reference resistor connected with an adjustable reference voltage for generating the reference current.

10. A method for generating a plurality of individually tunable gamma voltages corresponding to a symmetric gamma curve, the method comprising the steps of:

generating an adjustable common voltage and a plurality of adjustable voltages;

deriving a common gamma voltage and a plurality of first gamma voltages from the adjustable common voltage and the plurality of adjustable voltages, respectively;

mapping each of the plurality of first gamma voltages with the common gamma voltage as a reference to thereby generate a plurality of mapped voltages; and deriving a plurality of second gamma voltages from the plurality of mapped voltages with the common gamma voltage as a center axis for the plurality of first and second gamma voltages distributed substantially symmetric to each other;

wherein the common gamma voltage and the plurality of first and second gamma voltages are provided for the gamma voltages corresponding to the gamma curve.

11. The method of claim 10, wherein the step of generating a plurality of mapped voltages comprises the steps of:

subtracting one of the plurality of first gamma voltages from the common gamma voltage to thereby generate a difference; and summing the difference and the common gamma voltage to thereby generate a corresponding mapped voltage.

12. The method of claim 10, wherein the step of generating an adjustable common voltage and a plurality of adjustable voltages comprises the steps of:

generating a plurality of gamma currents of a substantially same magnitude; and generating the adjustable common voltage and the plurality of adjustable voltages each by a respective one of the plurality of gamma currents flowing through an adjustable resistive element.

13. The method of claim 12, further comprising the step of mirroring a reference current to thereby generate the plurality of gamma currents.

14. The method of claim 13, further comprising the step of applying a reference voltage to a second adjustable resistive element for generating the reference current.

15. The method of claim 13, further comprising the step of applying an adjustable reference voltage to a reference resistor for generating the reference current.

16. The method of claim 10, wherein the step of generating a plurality of mapped voltages comprises the steps of:

generating a first current from the common gamma voltage;

generating a second current in a first ratio to the first current;

generating a third current from one of the plurality of first gamma voltages;

generating a fourth current in a second ratio to the third current; and generating a corresponding mapped voltage from a difference between the second and fourth currents.

17. The method of claim 16, further comprising the steps of:

generating a first voltage from the second current with the first voltage in the first ratio to the common gamma voltage;

generating a second voltage from the fourth current with the second voltage in the second ratio to the one of the plurality of first gamma voltages; and subtracting the second voltage from the first voltage to generate the corresponding mapped voltage.

18. A gamma voltage generator for generating a plurality of individually and automatically tuned gamma voltages corresponding to a symmetric gamma curve, the generator comprising:

a current source for providing a reference current;

a current mirror for mirroring the reference current to generate a plurality of gamma currents; and means for generating a common gamma voltage and a plurality of first and second gamma voltages proportional to the plurality of gamma currents with the common gamma voltage as a center axis for the plurality of first and second gamma voltages distributed substantially symmetric to each other; said means for generating said common gamma voltage and a plurality of first and second gamma voltages including a mirror mapping circuit coupled to said common gamma voltage and first gamma voltages, to generate the plurality of said second gamma voltages;

whereby tuning the plurality of first gamma voltages automatically tunes the plurality of second gamma voltages; and wherein the common gamma voltage and the plurality of first and second gamma voltages are provided for the gamma voltages corresponding to the gamma curve.

19. The gamma voltage generator of claim 18, wherein the plurality of gamma currents have a substantially same magnitude.

20. The gamma voltage generator of claim 18, wherein the means for generating a common gamma voltage and a plurality of first and second gamma voltages comprises means for mapping the plurality of first gamma voltages to generate the plurality of second gamma voltages with the common gamma voltage as a center axis.

21. The gamma voltage generator of claim 20, wherein the means for mapping the plurality of first gamma voltages to generate the plurality of second gamma voltages comprises:

means for subtracting one of the plurality of first gamma voltages from the common gamma voltage to thereby generate a difference; and means for summing the difference and the common gamma voltage to thereby generate a corresponding second gamma voltage.

22. The gamma voltage generator of claim 20, wherein the means for mapping the plurality of first gamma voltages to generate the plurality of second gamma voltages comprises:

means for generating a first current in a first ratio to the common gamma voltage;

means for generating a second current in a first ratio to one of the plurality of first gamma voltages; and means for generating a corresponding second gamma voltage in a third ratio to a difference between the first and second currents.

23. The gamma voltage generator of claim 18, wherein the current source comprises an adjustable resistive element connected with a reference voltage for generating the reference current.

24. The gamma voltage generator of claim 18, wherein the current source comprises a resistive element connected with an adjustable reference voltage for generating the reference current.

25. The gamma voltage generator of claim 18, wherein the means for generating a common gamma voltage and a plurality of first and second gamma voltages comprises means for transforming the plurality of gamma currents to the common gamma voltage and the plurality of first and second gamma voltages.

26. A method for generating a plurality of individually and automatically tuned gamma voltages corresponding to a symmetric gamma curve, the method comprising the steps of:

providing a reference current;

mirroring the reference current for generating a plurality of gamma currents; and generating a common gamma voltage and a plurality of first and second gamma voltages proportional to the plurality of gamma currents with the common gamma voltage as a center axis for the plurality of first and second gamma voltages distributed substantially symmetric to each other;

establishing a mirror mapping circuit coupled to said common gamma voltage and first gamma voltages, for automatically tuning the plurality of second gamma voltages in response to a tuning of the plurality of first gamma voltages; and wherein the common gamma voltage and the plurality of first and second gamma voltages are provided for the gamma voltages corresponding to the gamma curve.

27. The method of claim 26, further comprising the step of applying the plurality of gamma currents each flowing through an adjustable resistive element to generate the common gamma voltage, one of the plurality of first gamma voltages, or one of the plurality of second gamma voltages.

28. The method of claim 26, further comprising the step of applying a reference voltage to an adjustable resistive element for generating the reference current.

29. The method of claim 26, further comprising the step of applying an adjustable reference voltage to a reference resistor for generating the reference current.

30. The method of claim 26, further comprising the step of mapping the plurality of first gamma voltages to generate the plurality of second gamma voltages with the common gamma voltage as a center axis.

31. The method of claim 30, wherein the step of generating the plurality of second gamma voltages comprises the steps of:

subtracting one of the plurality of first gamma voltages from the common gamma voltage to thereby generate a difference; and summing the difference and the common gamma voltage to thereby generate a corresponding second gamma voltage.

32. The method of claim 30, wherein the step of generating the plurality of second gamma voltages comprises the steps of:

generating a first current from the common gamma voltage;

generating a second current in a first ratio to the first current;

generating a third current from one of the plurality of first gamma voltages;

generating a fourth current in a second ratio to the third current; and generating a corresponding second gamma voltage from a difference between the second and fourth currents.

33. The method of claim 32, further comprising the steps of:

generating a first voltage from the second current with the first voltage in the first ratio to the common gamma voltage;

generating a second voltage from the fourth current with the second voltage in the second ratio to the one of the plurality of first gamma voltages; and subtracting the second voltage from the first voltage to generate the corresponding mapped voltage.

* * * * *